US008250813B2

(12) United States Patent
Robins

(10) Patent No.: US 8,250,813 B2
(45) Date of Patent: Aug. 28, 2012

(54) GUTTER GUARD

(75) Inventor: Evelyn M. Robins, Ruckersville, VA (US)

(73) Assignee: Leafsolution, LLC, Rochelle, VA (US)

( * ) Notice: Subject to any disclaimer, the term of this patent is extended or adjusted under 35 U.S.C. 154(b) by 0 days.

(21) Appl. No.: 13/097,098

(22) Filed: Apr. 29, 2011

(65) Prior Publication Data

US 2011/0265391 A1 Nov. 3, 2011

Related U.S. Application Data

(60) Provisional application No. 61/282,962, filed on Apr. 29, 2010.

(51) Int. Cl.
*E04D 13/00* (2006.01)

(52) U.S. Cl. ..... 52/12; 52/15; 248/48.1

(58) Field of Classification Search ..... 52/11, 12, 52/15; 248/48.1, 48.2
See application file for complete search history.

(56) References Cited

U.S. PATENT DOCUMENTS

| | | | | |
|---|---|---|---|---|
| 2,672,832 | A * | 3/1954 | Goetz | 52/12 |
| D223,829 | S | 6/1972 | Cook | |
| 3,950,951 | A | 4/1976 | Zukauskas | |
| 4,404,775 | A | 9/1983 | Demartini | |
| 4,769,526 | A | 9/1988 | Taouil | |
| 4,888,920 | A * | 12/1989 | Marulic | 52/12 |
| 4,905,427 | A * | 3/1990 | McPhalen | 52/12 |
| 4,937,986 | A * | 7/1990 | Way et al. | 52/12 |
| 5,010,696 | A | 4/1991 | Knittel | |
| 5,640,809 | A | 6/1997 | Iannelli | |
| 6,164,020 | A | 12/2000 | Nitch | |
| 6,427,388 | B1 * | 8/2002 | Brochu | 52/12 |
| 6,598,352 | B2 | 7/2003 | Higginbotham | |
| 6,745,516 | B2 | 6/2004 | Beyers | |
| 6,823,630 | B2 * | 11/2004 | Marra | 52/11 |
| 6,951,077 | B1 | 10/2005 | Higginbotham | |
| 7,174,688 | B2 | 2/2007 | Higginbotham | |
| 7,191,564 | B2 | 3/2007 | Higginbotham | |

(Continued)

FOREIGN PATENT DOCUMENTS

| | | |
|---|---|---|
| DE | 39 05 961 | 9/1989 |

(Continued)

OTHER PUBLICATIONS

Translation of Schaefer (DE 3829384).*
Translation of Pieper (DE 3905961).*

*Primary Examiner* — Brian Glessner
*Assistant Examiner* — Brian D Mattei
(74) *Attorney, Agent, or Firm* — Nixon & Vanderhye PC

(57) ABSTRACT

A gutter guard for mounting on a gutter. The gutter guard comprises an elongated panel extending laterally from an inner portion to an outer portion of an underlying gutter. The panel is of undulating construction and comprises a plurality of longitudinally extending, laterally spaced, elongated raised areas for retarding the flow of rain water across the panel. The raised areas are separated by longitudinally extending recess channels. The raised areas and recessed channels have a plurality of longitudinally extending, laterally spaced rows of longitudinally spaced first holes extending through the panel to enable rain water flowing outwardly across the panel to flow through the first holes into an underlying gutter. The first holes have a narrow end portion facing the inner side of the panel and expanding outwardly toward the outer side of the panel to facilitate spreading of rain water as it travels across the panel toward the outer side thereof.

16 Claims, 5 Drawing Sheets

U.S. PATENT DOCUMENTS

| | | | | |
|---|---|---|---|---|
| 7,310,912 | B2 | 12/2007 | Lenney et al. | |
| D559,957 | S | 1/2008 | Rasmussen | |
| 7,650,720 | B2 | 1/2010 | Ealer, Sr. | |
| 2002/0124476 | A1 | 9/2002 | Iannelli | |
| 2004/0244303 | A1* | 12/2004 | Seise, Jr. | 52/12 |
| 2005/0144851 | A1* | 7/2005 | Gramling | 52/11 |
| 2007/0199249 | A1 | 8/2007 | Beck et al. | |
| 2007/0234647 | A1 | 10/2007 | Higginbotham | |
| 2008/0190040 | A1* | 8/2008 | Graves | 52/12 |
| 2009/0031638 | A1 | 2/2009 | Iannelli | |
| 2009/0300995 | A1 | 12/2009 | Nikolopoulos | |

FOREIGN PATENT DOCUMENTS

| | | | |
|---|---|---|---|
| DE | 3829384 | A1 * | 3/1990 |
| GB | 2 084 210 | | 4/1982 |

* cited by examiner

GUTTER GUARD

CROSS REFERENCE TO RELATED APPLICATIONS

This application claims the priority of Provisional Patent Application No. 61/282,962 filed on Apr. 29, 2010.

BACKGROUND OF THE INVENTION

1. Field of the Invention

The present invention relates to gutter covers, and more particularly to a gutter guard or screen that enhances the flow of water into a gutter and prevents debris from collecting in the gutter and subsequently blocking the flow of water through the gutter.

2. Description of the Related Art

Gutters are open-top channels that collect and direct water away from a building and its foundation. The opening to the gutter channel must remain unobstructed in order for the gutter to function properly. It is common for debris, such as leaves, cones, seeds, pine needles and the like, to collect and block water flow. Obstruction of the gutter channel causes the gutter to overflow and become ineffective. Many people clean their gutters regularly as part of a preventive maintenance program, while others resort to such devices as covers and guards in an attempt to shield the gutter from the accumulation of debris in the channel.

Many of these guards use a single wire layer to cover the open top of the gutter. Other guards combine a wire layer with a mesh layer to keep debris out. The guard helps prevent large debris, such as cones or seeds, from settling in the gutters. However, smaller particles often slip past such layers. The structure of the guards is generally flat so that the layers lay flat above the opening. Sometimes the integrity of the guard cannot be maintained against heavy debris or debris that has collected and settled on the guard over time.

Consequently, there is a need for a device that covers the open top of a gutter channel and that prevents both large and small debris from entering and collecting in the gutter with resultant obstruction of the gutter, but freely permits the passage of rain water into the gutter to prevent surface water from collecting on the roof. It is further desirable that such a device enhance the flow of rain water into the gutter, be simple in construction, easy to manufacture and easy to install. The new and improved gutter guard of the present invention is not subject to the above-described disadvantages and meets the needs described herein.

BRIEF SUMMARY OF THE INVENTION

The new and improved gutter guard of the present invention can be installed on a gutter prior to the gutter being mounted on a building or may be installed on a gutter already mounted on a building. The gutter guard comprises elongated panels of any suitable length, such as 96 inches, which may be mounted end to end on a gutter and may be formed of any suitable material such as aluminum. Each panel is of a perforated, undulating or sinusoidal wave construction comprising a plurality of longitudinally extending, laterally spaced, elongated raised areas for retarding water flow across the panel with recessed channels therebetween. The perforations in the nature of first holes in the panel are closely spaced in longitudinally aligned relation and also in offset lateral relation, and are disposed in the longitudinally extending recessed channels and in the portions of the longitudinally extending raised areas facing the inner side of the panel that is intended to be mounted on a portion of a gutter that is attached or to be attached to the adjacent portion of a building or the like near the roof thereof.

The first holes are of a novel shape, such as a tear drop or the like, having a narrow end portion facing the inner side of the panel and expanding outwardly toward the outer side of the panel. In this manner, rain water flowing from the inner side to the outer side of the panel when it is mounted on a gutter is retarded by the elongated raised areas and spread by the outwardly expanding first holes as it rolls across the panel and thus decreases the water sheet thickness at the first holes to allow the water to drop more readily through the first holes into the gutter.

Near the outer side of the panel, which is intended to be mounted on the outer side of a gutter, there are provided a plurality of longitudinally extending and aligned second openings that are generally perpendicular to the transversely or laterally extending first holes in the channels and in the raised areas of the panel. The longitudinally extending second openings are intended to catch any rain water that may have flowed across the panel without falling through the first holes.

In certain embodiments of the gutter guard, the panel is provided with a row of longitudinally extending and aligned third openings near the inner or fascia side thereof to capture and dissipate any rainwater that may possibly migrate to the inner side owing to wind or the like.

In the embodiment of the gutter guard intended to be mounted on a gutter before it is installed on a building, each panel is provided with one or more longitudinally spaced tubular brackets extending at an angle from a position above the upper surface of the panel downwardly to the inner or fascia side thereof to enable a screw or other mounting member with a sealing washer to be inserted therein for the purpose of conveniently mounting the assembled gutter and gutter guard on a building adjacent the roof thereof and preventing the flow of water through the brackets. The tubular brackets may be snap-fitted into apertures in each panel or may be fixedly mounted thereon in any suitable manner. Each tubular bracket may be constructed to include a screw threadably mounted therein with a sealing washer to facilitate the mounting of the assembled gutter guard and gutter on a building.

The gutter guard is installed on a gutter such that it is tilted downwardly toward the outer side of the gutter to minimize the accumulation of debris thereon and to facilitate the removal of any debris that may collect thereon.

DETAILED DESCRIPTION OF THE PREFERRED EMBODIMENTS

Figure 1:
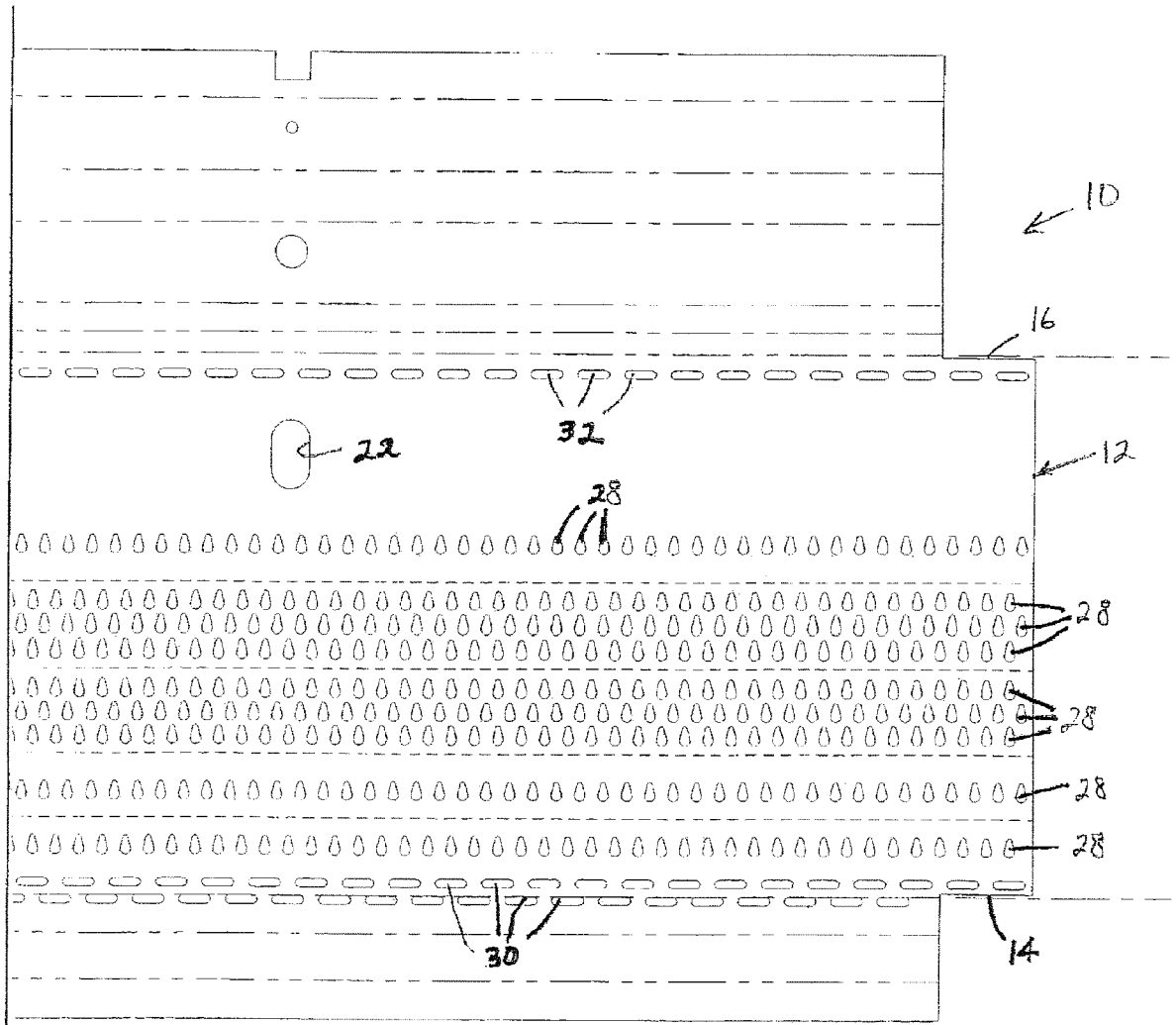
FIG. 1 is a partial plan view of the upper surface of a first embodiment of a gutter guard in blank form constructed in accordance with the principles of the present invention.
Figure 2:
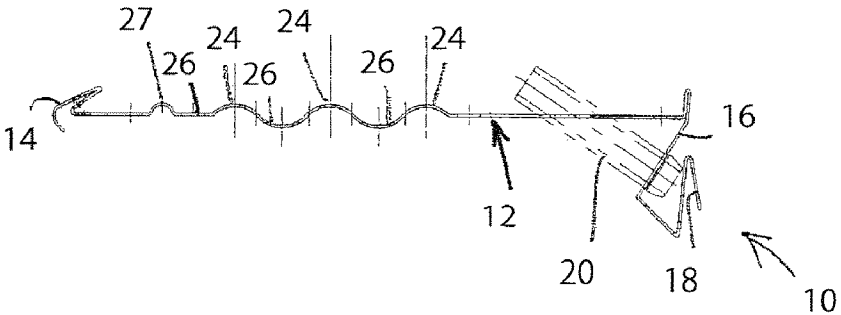
FIG. 2 is a side elevational view of the gutter guard of FIG. 1 in a shaped or formed condition.
Figure 7:
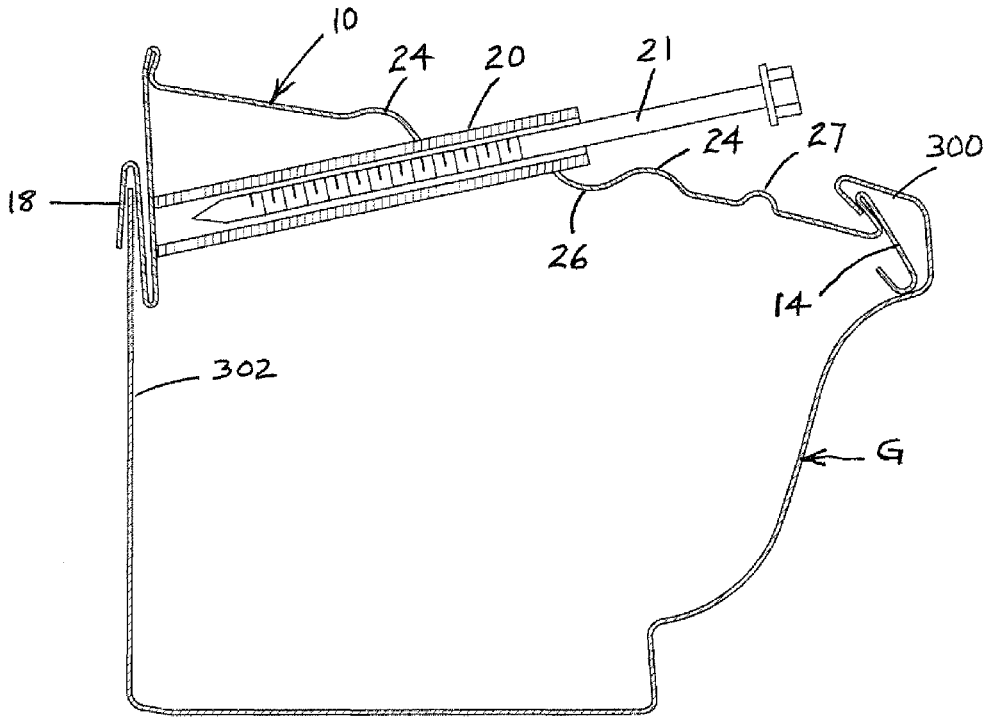
FIG. 7 is a side elevational view of the gutter guard of FIGS. 1 and 2 mounted on a gutter.

FIGS. 1 and 2 illustrate a first embodiment of the gutter guard of the present invention intended to be installed on a gutter (not shown) prior to the mounting of the gutter on a building or the like. The gutter guard 10 comprises a perforated panel 12 formed of a suitable material such as 0.025 inches thick aluminum having a width of approximately 5-6 inches and a length of approximately 96 inches. The panel has an outer side 14 and an inner or fascia side 16. The outer side 14 may be constructed in any suitable manner such as the folded construction shown in FIG. 2 so as to fit within the folded outer portion 300 of a gutter G shown in FIG. 7 and to be removably retained therein by a snap fit or the like. Alternatively, the outer side 14 may be welded or otherwise secured to the gutter G. The inner side 16 may be of any suitable construction for mounting on the inner side of a gutter G, such as the reversely bent, accordion-type construction shown in FIGS. 1 and 2 which enables the gutter guard panel 12 to be mounted on the inner side or panel 302 of a gutter G by positioning the outer fold 18 thereon as shown in FIG. 7. The panel 12 is constructed so as to be tilted downwardly toward the outer side of the gutter when it is mounted thereon to minimize the accumulation of debris thereon and facilitate the removal of debris therefrom.

For the mounting of the assembled gutter guard and gutter on a building, the elongated panel 12 is provided with one or more longitudinally spaced tubular brackets 20 mounted in any suitable location thereon and extending downwardly from a position above the panel through the mid portion and inner side of the panel for receiving a screw 21 or other connecting member with a sealing washer or the like to secure the assembled gutter guard and gutter to a building near the roof thereof and prevent the flow of water through the brackets. Each tubular bracket 20 may be snap-fitted in an opening 22 in the panel or may be otherwise fixably secured to the panel. As an illustrative example, the tubular brackets 20 may be longitudinally spaced approximately 16 inches on the panel 12. The screws and sealing washers may be preassembled with the brackets 20 to facilitate the use thereof.

The panel 12 is of undulating or sinusoidal wave construction and comprises a plurality of longitudinally extending, laterally spaced, elongated raised areas 24 for retarding the flow of water across the panel that are separated by recessed channels 26. As shown in FIG. 1, the raised areas 24 and recessed channels 26 are provided with a plurality of longitudinally extending, laterally spaced rows of longitudinally spaced first holes 28 extending through the panel 12 for the purpose of enabling rain water flowing outwardly across the upper surface of the panel 12 to flow through the first holes 28 into the gutter. Preferably, the first holes 28 extend through the portion of each raised area 24 facing the inner side of the panel 12. As shown in FIG. 1, the first holes 28 are of a novel shape such as a tear drop or the like, having a narrow end portion facing the inner side of the panel and expanding outwardly toward the outer side of the panel 12. The novel expanding shape of the first holes 28 facilitates the spreading of the rain water sheet as it rolls across the panel 12 from the inner side 16 to the outer side 14 thereof. In this manner, the elongated raised areas 24 retard the water flow and the first holes 28 decrease the water sheet thickness and thereby allow the water to drop more readily through the first holes 28 into the underlying gutter.

To further retard the flow of water that may pass over the elongated raised areas 24 and first holes 28, the panel 12 may be provided with a further elongated raised area 27 near the outer side thereof that is of greater height than the raised areas 24, as shown in FIG. 2. The raised area 27 may or may not be perforated.

Near the outer side 14 thereof, the panel 12 is further provided with a plurality of longitudinally extending rows of spaced, longitudinally extending second holes 30 that extend generally transverse to the first holes 28. The longitudinally extending second holes 30 are provided at the outer side 14 of the panel 12 and in the outer lip or portion thereof for the purpose of capturing rain water that may flow over the first holes 28 during high rainfalls.

The panel 12 may be further provided with a longitudinally extending row or rows of spaced, longitudinally extending third holes 32 near the inner side 16 thereof for the purpose of capturing any water that may possibly migrate inwardly on the panel during periods of high wind or the like.

The longitudinally extending, laterally spaced, elongated raised areas 24 and 27 in the panel 12 serve to decrease the velocity of rain water flowing outwardly across the panel and to facilitate the flow of rain water through the first holes 28 in the raised areas 24 and in the recessed channels 26 between the raised areas 24.

The first holes 28, second holes 30 and third holes 32 in the panel 12 may be of any suitable size. As illustrative examples, the first holes 28 may be approximately 0.195 inches in length and approximately 0.100 inches in maximum width thereof. The elongated second holes 30 and third holes 32 may be approximately 0.330 inches in length and approximately 0.100 inches in width. Also, the first holes 28 may be spaced longitudinally approximately 0.250 inches from each other and the second holes 30 and third holes 32 may be spaced longitudinally approximately 0.500 inches from each other. The rows of first holes 28 may be spaced approximately 0.250 inches from each other and the rows of second holes 30 may be spaced approximately 0.250 inches from each other.

Figure 3:
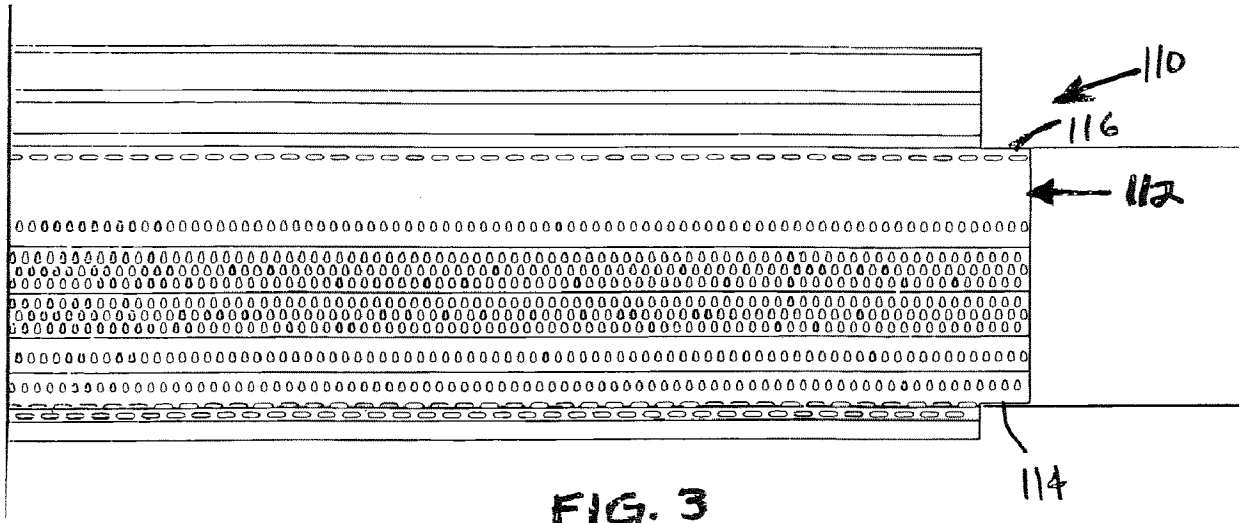
FIG. 3 is a partial plan view of the upper surface of a second embodiment of a gutter guard in blank form constructed in accordance with the principles of the present invention.
Figure 4:
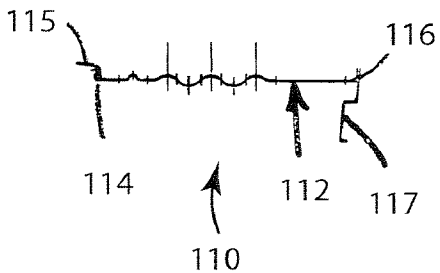
FIG. 4 is a side elevational view of the gutter guard of FIG. 3 in a shaped or formed condition.

A second embodiment of a gutter guard 110 of the present invention is shown in FIGS. 3 and 4 and is constructed to be mounted on a gutter that is already secured to a building or the like. The panel 112 of the gutter guard 110 is substantially the same in construction with respect to the longitudinal raised areas, recessed channels and holes as the panel 12 shown in FIGS. 1 and 2. The outer side 114 of the panel 112 is provided with any suitable construction, such as a tab 115 for securing the outer side 114 of the panel 112 to the adjacent outer portion of a gutter. Similarly, the inner side 116 of the panel 12 is provided with any suitable construction, such as a flange 117 or the like which can be mounted on or secured to the adjacent portion of the inner side of a gutter.

The gutter guard shown in FIGS. 3 and 4 does not include the tubular brackets 20 shown in FIGS. 1 and 2.

Figure 5:
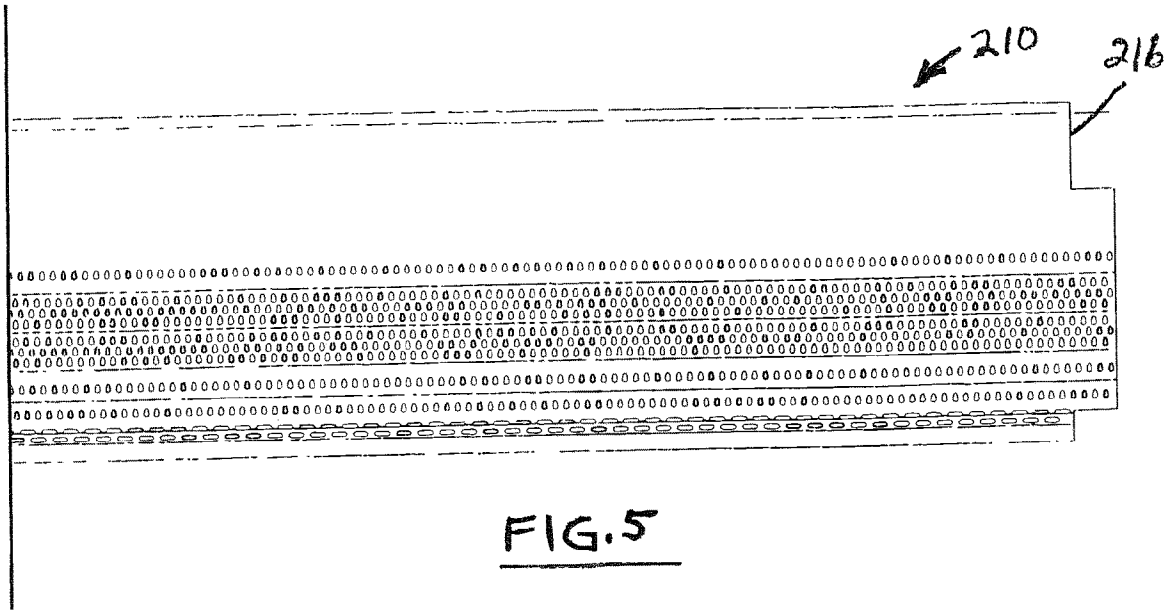
FIG. 5 is a partial plan view of the upper surface of a third embodiment of a gutter guard in blank form constructed in accordance with the principles of the present invention.
Figure 6:
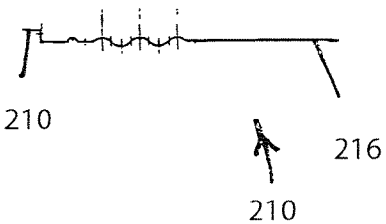
FIG. 6 is a side elevational view of the gutter guard shown in FIG. 5 in a shaped or formed condition.

FIGS. 5 and 6 illustrate a third embodiment of a gutter guard 210 in accordance with the present invention. The gutter guard 210 is substantially the same in construction as the gutter guard 110 shown in FIGS. 3 and 4 with the exception that the inner side 216 of the gutter guard 210 extends laterally inwardly in a planar manner so as to extend over the inner side of a gutter and under adjacent roof shingles when it is mounted on the gutter. Because the inner side 216 extends under roof shingles, it is not provided with the row of third holes 32 shown in FIGS. 1 and 2. Like the gutter guard of FIG. 4, the outer side of the gutter guard 210 is provided with a tab 215 for securing to the adjacent outer portion of a gutter.

From the foregoing description, it will be readily seen that the different embodiments of the gutter guard of the present invention shown and described herein embody many novel features, are easily mounted on a gutter before or after it is installed on a building, and are of a simple construction that is very effective in decreasing rain water velocity over the upper surface of a gutter guard and enhancing the flow of the rain water through the holes in the gutter guard panel and into the underlying gutter. Also, the different embodiments of the gutter guard of the present invention effectively prevent debris of all types from entering the underlying gutter.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A gutter guard for mounting on and covering a gutter, the gutter guard comprising:

an elongated panel constructed to extend laterally from an inner portion to an outer portion of an underlying gutter, the panel being of undulating construction and comprising a plurality of longitudinally extending, laterally spaced, elongated raised areas for retarding the flow of rain water across the panel from an inner side to an outer side thereof, the raised areas being separated by longitudinally extending recessed channels, the raised areas and recessed channels having a plurality of longitudinally extending, laterally spaced rows of longitudinally spaced first holes extending through the panel to enable rain water flowing outwardly across the panel to flow through the first holes into an underlying gutter, wherein the panel is provided with a plurality of longitudinally spaced tubular brackets secured thereto and extending downwardly and inwardly through openings in the panel to the inner side thereof, each tubular bracket being constructed to receive a screw or other connecting member with a sealing washer for connecting the gutter guard and a gutter secured thereto to an adjacent building portion.

2. The gutter guard of claim 1 wherein the first holes in adjacent rows are offset longitudinally from each other to facilitate the capture of rain water flowing outwardly across the panel.

3. The gutter guard of claim 1 wherein the panel comprises a longitudinally extending raised area near the outer side thereof that is of greater height than the other raised areas to further retard the flow of rain water outwardly across the panel.

4. The gutter guard of claim 1 wherein the panel is provided with a plurality of longitudinally extending, laterally spaced rows of second holes near the outer side thereof and spaced outwardly from the rows of first holes, the second holes being elongated in a longitudinal direction so as to be substantially transverse to the first holes to facilitate the capture of rain water that may flow past the first holes.

5. The gutter guard of claim 4 wherein the second holes are about 0.333 inches in length and 0.100 inches in width.

6. The gutter guard of claim 1 wherein the panel is provided with a longitudinally extending row of third holes near the inner side thereof to capture any rain water on the panel that may migrate inwardly during periods of high wind.

7. The gutter guard of claim 6 wherein the third holes are about 0.330 inches in length and 0.100 inches in width.

8. The gutter guard panel of claim 1 wherein the inner side of the panel is constructed to be attached to the inner side of an underlying gutter or to an adjacent building portion.

9. The gutter guard of claim 8 wherein the inner side of the panel has a downwardly folded portion constructed to fit over the adjacent inner side of an underlying gutter.

10. The gutter guard of claim 8 wherein the outer side of the panel is folded and is constructed to be fitted within an adjacent folded outer portion of a gutter.

11. The gutter guard of claim 10 wherein the outer side of the panel is constructed to be snap-fitted within the adjacent folded outer portion of the gutter.

12. The gutter guard of claim 1 wherein the tubular brackets are snap-fitted in the openings in the panel.

13. The gutter of claim 1 wherein the first holes are about 0.195 inches in length and 0.100 inches in maximum width.

14. The gutter guard of claim 13 wherein the first holes are spaced longitudinally about 0.250 inches from each other, and the rows of first holes are spaced laterally about 0.250 inches from each other.

15. The gutter guard of claim 1 wherein the first holes have a narrow end portion facing the inner side of the panel and expanding outwardly toward the outer side of the panel to facilitate the spreading of rain water as it travels across the panel toward the outer side thereof to allow the rain water to drop more readily through the first holes.

16. The gutter guard of claim 15 wherein the first holes are of a teardrop shape.

* * * * *